US006237501B1

(12) United States Patent
Miller et al.

(10) Patent No.: US 6,237,501 B1
(45) Date of Patent: May 29, 2001

(54) THREE-POINT SUSPENSION SYSTEM FOR MOUNTING A TOOL TO A RAIL SYSTEM

(75) Inventors: Terry W Miller, Richmond; Timothy A Dering, Rochester Hills; Emad Z Attalla, Troy, all of MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 09/514,675

(22) Filed: Feb. 28, 2000

(51) Int. Cl.[7] ..... B61B 5/00

(52) U.S. Cl. ..... 104/91; 104/89; 104/94; 104/95; 409/202; 409/212; 248/317; 248/323; 212/226

(58) Field of Search ..... 104/89, 91, 94, 104/95, 148, 154, 155; 409/202, 212; 248/317, 323, 320, 298.1; 212/226, 328

(56) References Cited

U.S. PATENT DOCUMENTS

| | | | |
|---|---|---|---|
| 1,530,337 | | 3/1925 | Wickland . |
| 2,556,428 | | 6/1951 | Kooken . |
| 3,076,561 | | 2/1963 | Rogers . |
| 3,807,591 | | 4/1974 | Zinno et al. . |
| 4,181,231 | | 1/1980 | Morrissey, Jr. et al. . |
| 4,218,045 | | 8/1980 | Weismann . |
| 4,256,230 | | 3/1981 | Clark, Jr. et al. . |
| 4,289,076 | * | 9/1981 | Miller ..... 105/163 R |
| 4,467,911 | * | 8/1984 | Forshee ..... 198/648 |
| 4,708,251 | | 11/1987 | Picard et al. . |
| 4,776,748 | | 10/1988 | Klein . |
| 4,836,111 | * | 6/1989 | Kaufmann ..... 104/89 |
| 5,158,188 | | 10/1992 | Nordberg . |
| 5,264,067 | | 11/1993 | Kuchta et al. . |
| 5,788,096 | | 8/1998 | Wilcox . |
| 6,048,143 | * | 4/2000 | Chang et al. ..... 409/201 |

* cited by examiner

*Primary Examiner*—S. Joseph Morano
*Assistant Examiner*—Frantz F. Jules
(74) *Attorney, Agent, or Firm*—Roland A. Fuller, III

(57) ABSTRACT

A suspension system for suspending a tool from a pair of parallel rails. The suspension system consists of a support structure, a tool mounting interface and exactly three trolley assemblies. The support structure has three trolley assembly mounting structures with a first one of the trolley assembly mounting structures positioned on a first side of the support structure and the remaining trolley assembly mounting structures are positioned on the opposite side. The tool mounting interface is adapted to couple the tool to the support structure. Each of the trolley assembly mounting structures is coupled to a trolley assembly. Each trolley assembly has at least one trolley set with a plurality of wheels adapted to roll on one of the parallel rails. The three trolley assemblies collectively adapted to exert a reaction force onto the pair of parallel rails equal to the weight of the suspension system and the tool.

20 Claims, 3 Drawing Sheets

THREE-POINT SUSPENSION SYSTEM FOR MOUNTING A TOOL TO A RAIL SYSTEM

BACKGROUND OF THE INVENTION

1. Technical Field

The present invention relates generally to suspension systems for rail-supported tools and more particularly to a suspension system having reduced weight and frictional characteristics to reduce the effort with which a tool is moved along a set of rails.

2. Discussion

In assembly plants for automotive vehicles, it is common practice to hang a pair of rails or runways above or parallel to an assembly line. The pair of rails are then used to hang various tools, such as hoists, fastening equipment, fixtures, gages and articulating arms which are used in the assembly process. Often times, these tools can be hung from a single rail with a single trolley set where the weight of the tool is relatively small. The trolley set includes a plurality of rollers which permit the tool to be moved in a direction parallel the rail.

If the tool is configured in a manner where it is not desirable to hang it from a single rail, as when the weight of the tool prevents it from being safely hung from a single rail, a suspension system having a support structure is typically employed. Generally, the support structures used in these suspension systems are H-shaped with four trolley assemblies, one trolley assembly being coupled to each leg of the support structure. While such suspension systems have proven themselves to be robust, several drawbacks have been noted.

One drawback with the suspension systems having an H-shaped support structure concerns their weight and the ease with which they can be pushed along the rails to move the tool to a desired location. As these suspension systems typically weigh up to several hundred pounds, it is frequently difficult for assembly technicians to move the tool and suspension system along the rails to a desired position.

This situation may be alleviated through the incorporation of an electric or pneumatic tractor system to the suspension system wherein the tractor system includes a drive motor to push the suspension system along the rails. Such tractor systems, however, are costly to purchase and maintain and are often more cumbersome to operate than suspension systems that must be manually positioned.

SUMMARY OF THE INVENTION

It is one object of the present invention to provide a suspension system for a tool which may be easily positioned in a manual manner along a rail system.

It is a more specific object of the present invention to provide a suspension system for mounting a tool to a pair of rails which uses three trolley assemblies to reduce friction and drag between the suspension system and the rail.

It is another object of the present invention to provide a suspension system for a tool which utilizes a triangularly shaped support structure.

In one form, the present invention provides a suspension system for suspending a tool from a pair of parallel rails. The suspension system consists of a support structure, a tool mounting interface and exactly three trolley assemblies. The support structure has three trolley assembly mounting structures wherein a first one of the trolley assembly mounting structures positioned on a first side of the support structure and the remaining trolley assembly mounting structures are positioned on the opposite side. The tool mounting interface is adapted to couple the tool to the support structure. Each of the trolley assembly mounting structures is coupled to a trolley assembly. Each trolley assembly has at least one trolley set with a plurality of wheels adapted to roll on one of the parallel rails. The three trolley assemblies collectively adapted to exert a reaction force onto the pair of parallel rails equal to the weight of the suspension system and the tool.

Additional advantages and features of the present invention will become apparent from the subsequent description and the appended claims, taken in conjunction with the accompanying drawings.

BRIEF DESCRIPTION OF THE DRAWINGS

FIG. 4 is a partial exploded perspective view of a suspension system similar to that of FIG. 1.

DETAILED DESCRIPTION OF THE PREFERRED EMBODIMENT

Figure 1:
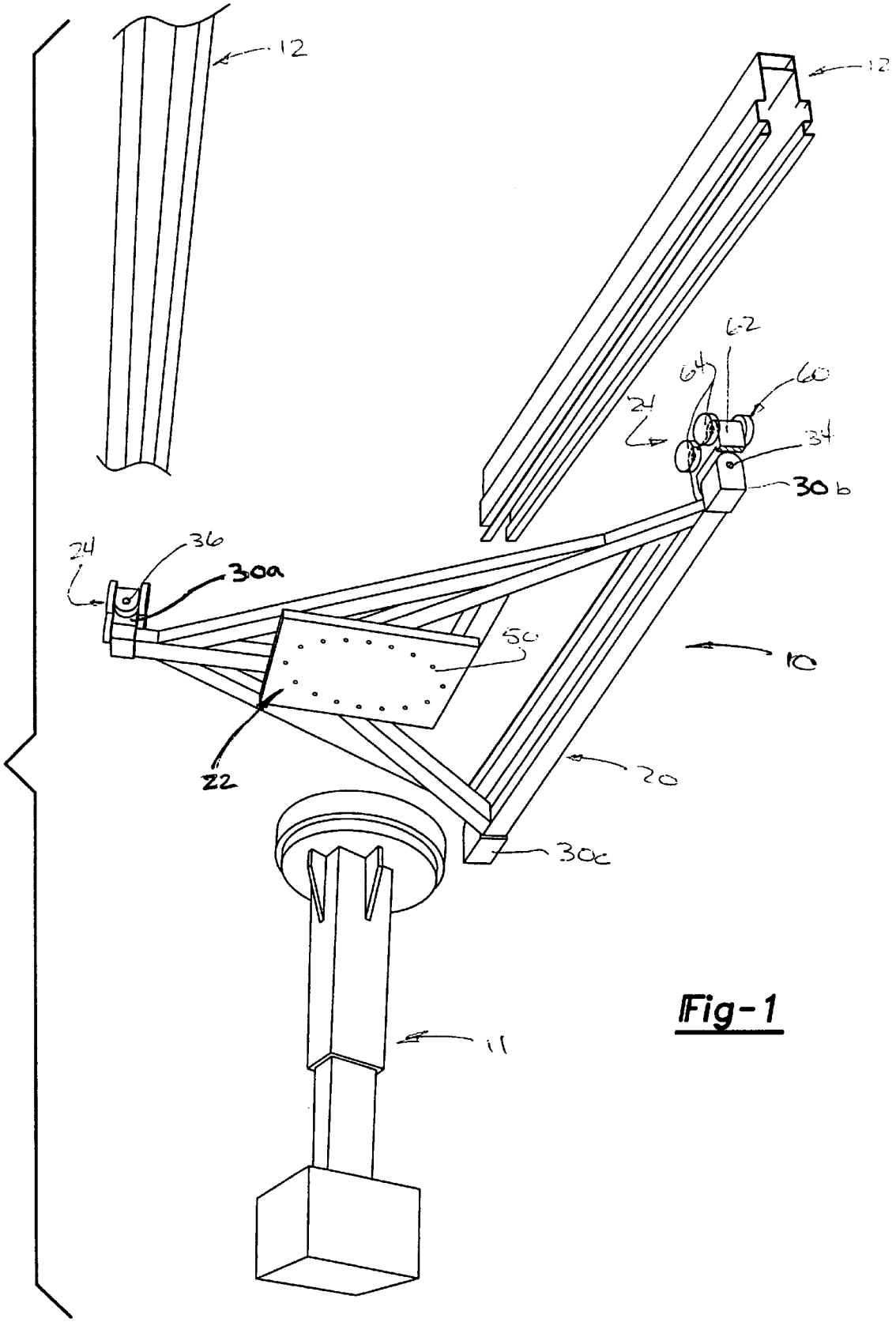
FIG. 1 is an exploded perspective view of a rail system illustrating a tool with a suspension system constructed in accordance with the teachings of the present invention.
Figure 2:
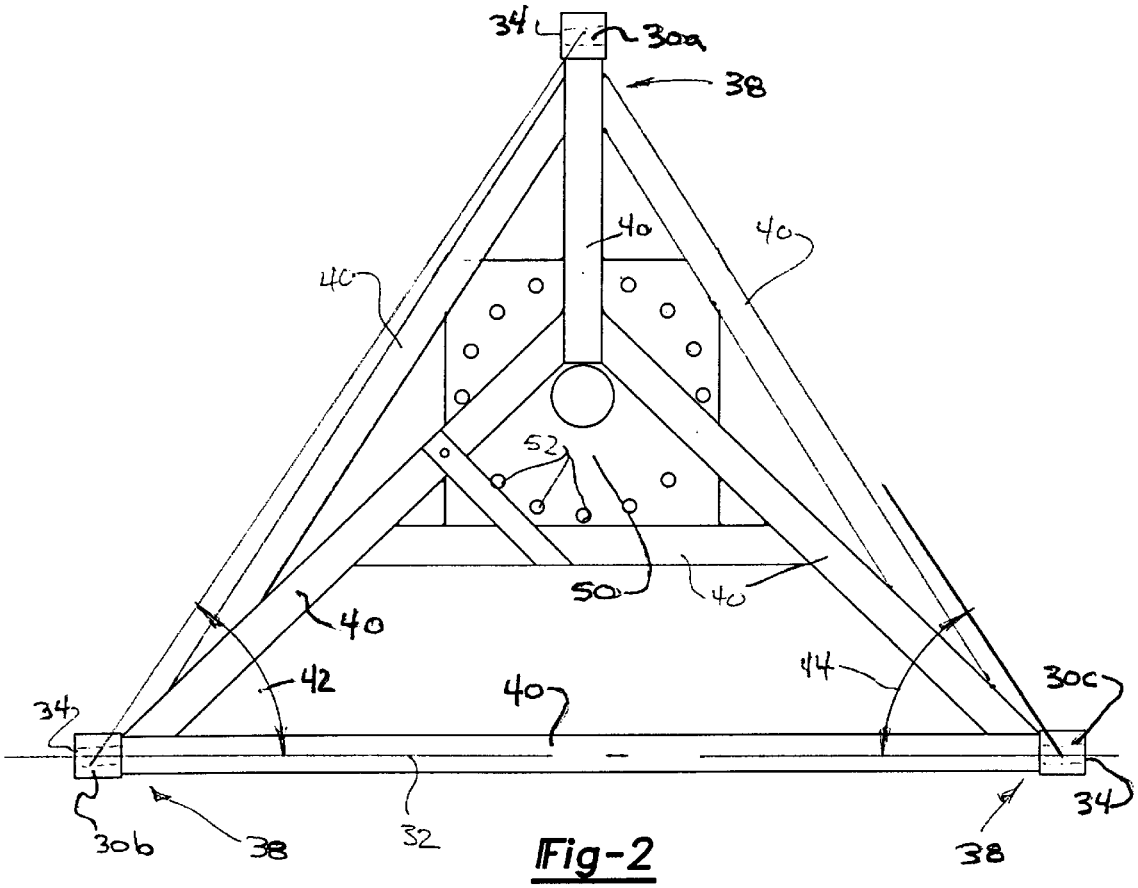
FIG. 2 is a plan view of a portion of the suspension system of FIG. 1.
Figure 3:
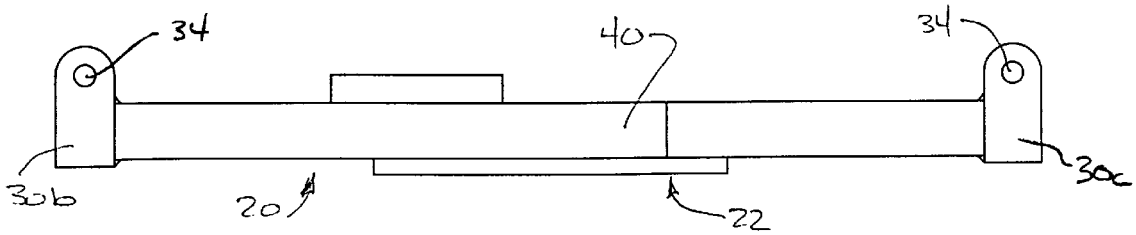
FIG. 3 is a side elevation view of a portion of a suspension system similar to that of FIG. 1.
Figure 1:
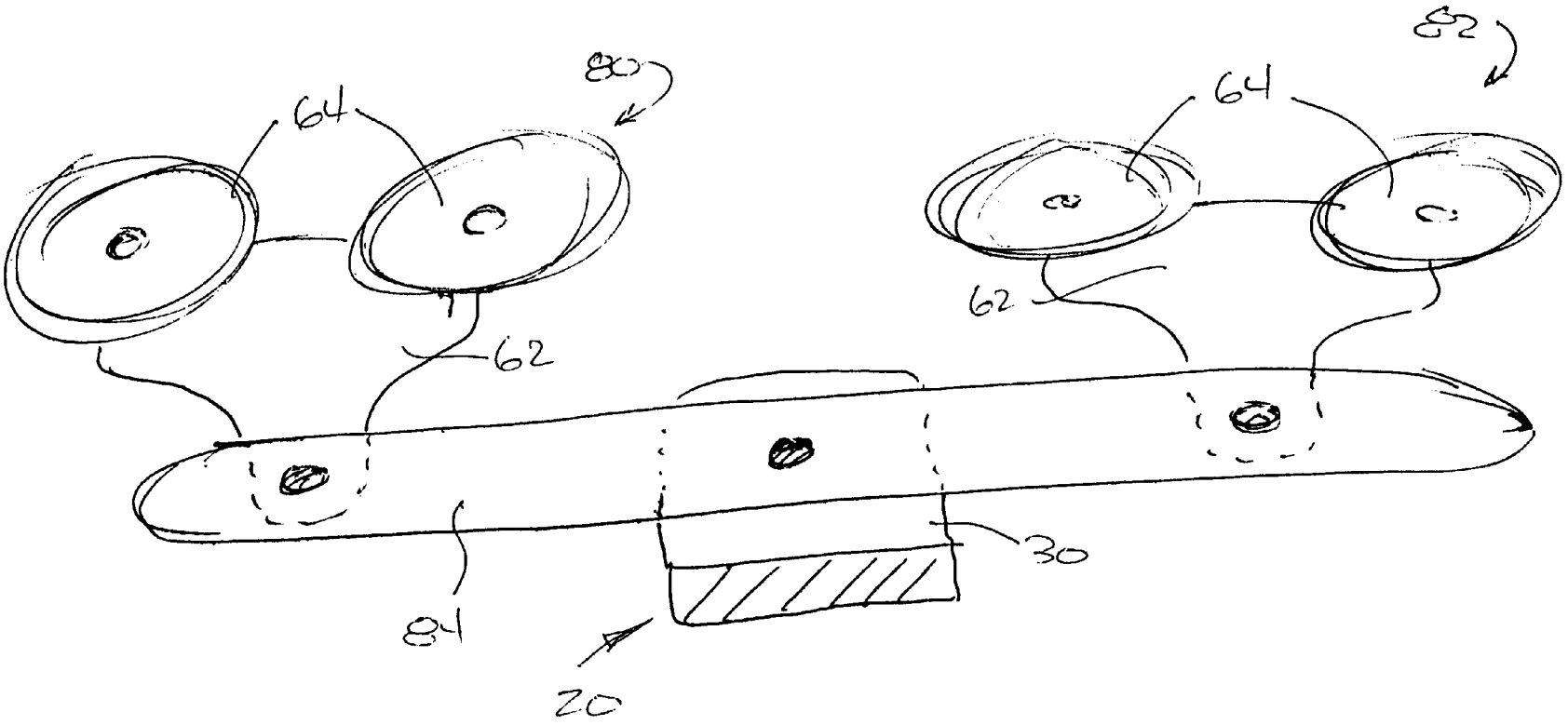

In FIGS. 1 through 3, a suspension system constructed in accordance with the teachings of the present invention is generally indicated by reference numeral 10. Suspension system 10 supports a tool 11 and is shown to hang from a pair of parallel rails 12. Suspension system 10 comprises a support structure 20, a tool mounting interface 22 and exactly three trolley assemblies 24. Only three trolley assemblies 24 are used in the suspension system 10 so as to substantially reduce friction and drag between the suspension system 10 and the rails 12.

The support structure 20 is shown to have three trolley assembly mounting structures 30 with a first one of the trolley assembly mounting structures 30*a* being positioned on a first side of the support structure 20 and the remaining trolley assembly mounting structures 30*b* and 30*c* being positioned on an opposite side along a base axis 32. Each of the trolley assembly mounting structures 30 includes a mounting aperture 34 for receiving a mounting member 36 of the trolley assembly 24. Depending on the configuration of the trolley assemblies 24 uses, the mounting aperture 34 may be aligned parallel to the rails 12 as shown in FIG. 1, or may be perpendicular to the rails as shown in FIG. 3.

Preferably, the support structure 20 is generally triangular in shape having a trolley assembly mounting structure 30 at each of its corners 38. To reduce the weight of the suspension system 10 to the fullest extent possible, support structure 20 is preferably a weldment fabricated from a plurality of tubular members 40.

In fabricating support structure 20, it is preferable that the angle 42 defined by the trolley assembly mounting structure 30*a*, trolley assembly mounting structures 30*b* and the base axis 32 be equal to the angle 44 defined by the trolley assembly mounting structure 30*a*, trolley assembly mounting structures 30*c* and the base axis 32, with the magnitude of angles 42 and 44 ranging from about 40 degrees to about 80 degrees, and preferably equaling about 60 degrees. Testing has shown that this configuration provides a significant reduction in the effort to push the support structure 20 and tool 11.

Tool mounting interface 22 is fixedly coupled to support structure 20 and is adapted to couple the tool 11 to the support structure 20. In the particular embodiment illustrated, the tool mounting interface 22 includes a mounting plate 50 having a plurality of tapped holes 52 which permit the tool 11 to be fixedly but removably coupled to the mounting plate 50. Construction in this manner simplifies the maintenance of the suspension system 10 and the tool 11 and permits the suspension system 10 to be readily reused.

The trolley assemblies 24 are commercially available units having at least one trolley set 60 with a mounting member 36, a yoke 62 and a plurality of wheels 64 which are adapted to roll on one of the parallel rails 12. Each of the trolley assemblies 24 is positioned proximate a trolley assembly mounting structure 30 and the mounting member 36 is positioned through the yoke 62 and the mounting aperture in the trolley assembly mounting structure 30. The trolley assemblies 24 are collectively adapted to exert a reaction force onto the pair of parallel rails 12 which is equal to the weight of the suspension system 10 and the tool 11.

In situations where the weight of the tool 11 is particularly heavy, each of the trolley assemblies 24 may include a first trolley set 80, a second trolley set 82, a load bar 84 and a mounting member 36 as shown in FIG. 4. The mounting member 36 couples the load bar 84 to a trolley assembly mounting structure 30 and the first and second trolley assemblies 80 and 82 are positioned on opposite sides of the load bar 84.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the description of the appended claims.

We claim:

1. A suspension system for suspending a tool from a pair of parallel rails, the suspension system consisting of a support structure, a tool mounting interface and exactly three trolley assemblies, the support structure having first, second and third trolley assembly mounting structures, the first trolley assembly mounting structure being positioned on a first side of the support structure and the second and third trolley assembly mounting structures being positioned on a second side of the support structure opposite the first side and along a base axis, the tool mounting interface adapted to couple the tool to the support structure, each of the trolley assembly mounting structures having a plurality of wheels, a first one of the trolley assemblies being coupled to the first trolley assembly mounting structure and oriented in a manner such that the wheels of the first trolley assembly roll on a first one of the pair of parallel rails, a second one of the trolley assemblies being coupled to the second trolley assembly mounting structure and oriented in a manner such that the wheels of the second trolley assembly roll on a second one of the pair of parallel rails, a third one of the trolley assemblies being coupled to the third trolley assembly mounting structure and oriented in a manner such that the wheels of the third trolley assembly roll on the second one of the pair of parallel rails, the exactly three trolley assemblies collectively spacing the support structure apart from and below the pair of parallel rails and being adapted to exert a reaction force onto the pair of parallel rails equal to the weight of the suspension system and the tool.

2. The suspension system of claim 1, wherein the support structure is generally triangular in shape.

3. The suspension system of claim 2, wherein a first angle is defined between the first trolley assembly mounting structure, the second trolley assembly mounting structure and the base axis and a second angle is defined between the first trolley assembly mounting structure, the third trolley assembly mounting structure and the base axis, wherein the first angle is equal to the second angle.

4. The suspension system of claim 3, wherein the first and second angles range between about 40 degrees to about 80 degrees.

5. The suspension system of claim 2, wherein each of the exactly three trolley assemblies is coupled to a corner of the generally triangularly shaped support structure.

6. The suspension system of claim 1, wherein the tool mounting interface is a mounting plate having a plurality of tapped holes.

7. The suspension system of claim 1, wherein the support structure is a weldment formed from a plurality of tubular members.

8. The suspension system of claim 1, wherein each of the exactly three trolley assemblies includes a first trolley set, a second trolley set and a load bar interconnecting the first and second trolley sets, each load bar being coupled to an associated one of the first, second and third trolley assembly mounting structures.

9. The suspension system of claim 1, wherein each of the exactly three trolley assemblies includes a trolley set having a mounting member, each of the mounting members coupling a respective one of the trolley assemblies to a respective one of the first, second and third trolley assembly mounting structures.

10. The suspension system of claim 1, wherein each of the first, second and third trolley assembly mounting structures includes a mounting aperture with an axis aligned to the pair of parallel rails.

11. The suspension system of claim 1, wherein each of the first, second and third trolley assembly mounting structures includes a mounting aperture with an axis perpendicular to the pair of parallel rails.

12. A suspension system for suspending a tool from a pair of parallel rails, the suspension system consisting of a triangularly-shaped support structure, a tool mounting interface and exactly three trolley assemblies, the triangularly-shaped support structure having first, second and third trolley assembly mounting structures, each of the first, second and third trolley assembly mounting structures being positioned on a corner of the triangularly-shaped support structure, the tool mounting interface adapted to couple the tool to the triangularly-shaped support structure, each trolley assembly having at least one trolley set with a plurality of wheels, a first one of the trolley assemblies being coupled to the first trolley assembly mounting structure and oriented in a manner such that the wheels of the first trolley assembly roll on a first one of the pair of parallel rails, a second one of the trolley assemblies being coupled to the second trolley assembly mounting structure and oriented in a manner such that the wheels of the second trolley assembly roll on a second one of the pair of parallel rails, a third one of the trolley assemblies being coupled to the third trolley assembly mounting structure and oriented in a manner such that the wheels of the third trolley assembly roll on the second one of the pair of parallel rails, the exactly three trolley assemblies collectively spacing the triangularly-shaped support structure apart from and below the pair of parallel rails and being adapted to exert a reaction force onto the pair of parallel rails equal to the weight of the suspension system and the tool.

13. The suspension system of claim 12, wherein the second and third trolley assembly mounting structures are positioned along a base axis with the first trolley assembly mounting structure being offset therefrom, a first angle being defined between the first trolley assembly mounting structure, the second trolley assembly mounting structure and the base axis and a second angle being defined between the first trolley assembly mounting structure, the third trolley assembly mounting structure and the base axis, wherein the first angle is equal to the second angle.

14. The suspension system of claim 13, wherein the first and second angles are range between about 40 degrees to about 80 degrees.

15. The suspension system of claim 12, wherein the tool mounting interface is a mounting plate having a plurality of tapped holes.

16. The suspension system of claim 12, wherein the support structure is a weldment formed from a plurality of tubular members.

17. The suspension system of claim 12, wherein each of the exactly three trolley assemblies includes a first trolley set, a second trolley set and a load bar interconnecting the first and second trolley sets, each load bar being coupled to an associated one of the first, second and third trolley assembly mounting structures.

18. The suspension system of claim 12, wherein each of the exactly three trolley assemblies includes a trolley set having a mounting member, each of the mounting members coupling a respective one of the trolley assemblies to a respective one of the first, second and third trolley assembly mounting structures.

19. The suspension system of claim 12, wherein each of the first, second and third trolley assembly mounting structures includes a mounting aperture with an axis aligned to the pair of parallel rails.

20. The suspension system of claim 12, wherein each of the first, second and third trolley assembly mounting structures includes a mounting aperture with an axis perpendicular to the pair of parallel rails.

* * * * *